United States Patent [19]

Kudlac

[11] Patent Number: 5,010,826

[45] Date of Patent: Apr. 30, 1991

[54] PLATFORM HAVING A NOTCH AND PLUG MEMBER THEREFOR

[76] Inventor: Barbara L. Kudlac, Apt. 14A, 3298 S. Lakewood, Tulsa, Okla. 74135

[21] Appl. No.: 453,845

[22] Filed: Dec. 20, 1989

[51] Int. Cl.[5] ..... A47B 85/00

[52] U.S. Cl. ..... 108/25; 206/564; 206/565; 248/506; 297/188

[58] Field of Search ..... 108/24–26.1; 297/148, 153, 154, 188, 194; 206/557, 564, 565, 426, 217; 248/310, 311.2, 346, 506; 229/1.5 H; 220/234; 211/126, 88

[56] References Cited

U.S. PATENT DOCUMENTS

| | | | |
|---|---|---|---|
| 774,479 | 11/1904 | Lange | 206/426 |
| 1,026,780 | 5/1912 | Asheim | 248/346 |
| 1,422,397 | 7/1922 | Watson | 108/26 |
| 1,952,568 | 3/1934 | Schapp et al. | 206/564 X |
| 1,962,556 | 6/1934 | Eberhardt, Jr. | 206/565 X |
| 2,602,310 | 7/1952 | Hansen | 206/426 |
| 2,711,636 | 6/1955 | Howell | 248/506 |
| 2,850,079 | 9/1958 | Prushnok et al. | 248/506 |
| 3,111,095 | 11/1963 | Goodman | 108/26 |
| 3,881,674 | 5/1975 | Greene, III | 206/426 X |
| 4,548,440 | 10/1985 | Meslin et al. | 108/26 X |
| 4,606,576 | 8/1986 | Jones | 297/153 |
| 4,643,381 | 2/1987 | Levy | 248/154 |
| 4,662,676 | 5/1987 | Havelock | 108/26 X |
| 4,798,413 | 1/1989 | Capelli | 108/26 X |
| 4,884,512 | 12/1989 | Kelly et al. | 108/26 |
| 4,908,066 | 3/1990 | Taylor et al. | 297/188 X |
| 4,927,024 | 5/1990 | Lloyd | 206/562 |

FOREIGN PATENT DOCUMENTS

| | | | |
|---|---|---|---|
| 398083 | 9/1933 | United Kingdom | 248/154 |

*Primary Examiner*—Bryon P. Gehman

*Attorney, Agent, or Firm*—Richard C. Litman

[57] ABSTRACT

A tray for use on a high chair in which provision is made for immobilizing food receptacles such as bowls and cups through the use of static retainers which are part of the structure of the tray. One form of the invention utilizes grooved indentations to hold a mating base of a food receptacle. A second embodiment uses surface clips to hold the base of a food container.

7 Claims, 3 Drawing Sheets

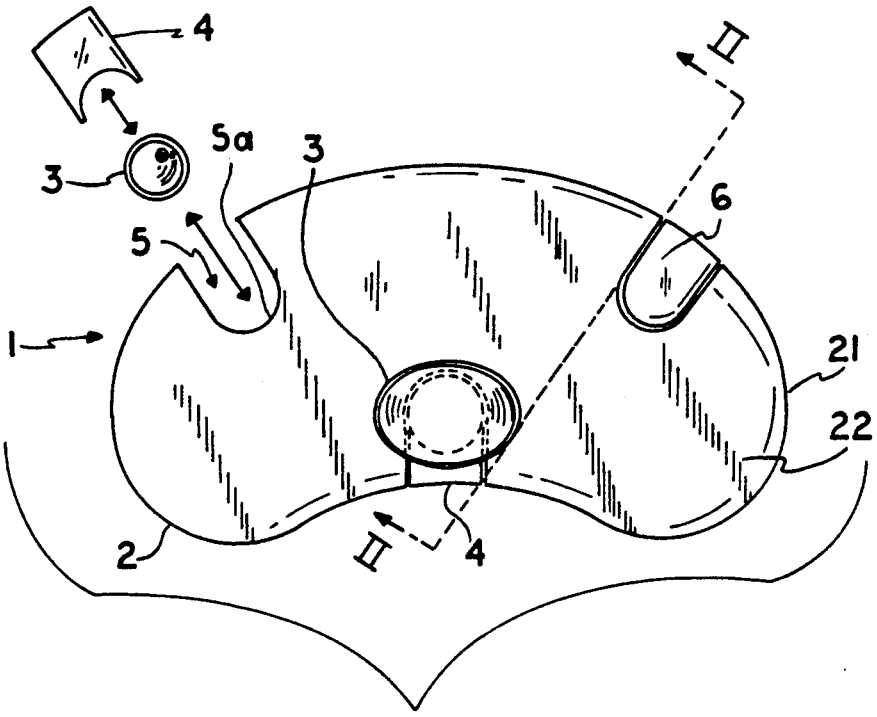
FIG. 1
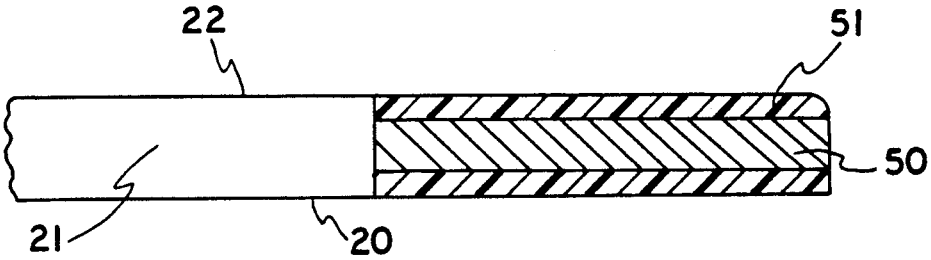
FIG. 2
FIG. 3A
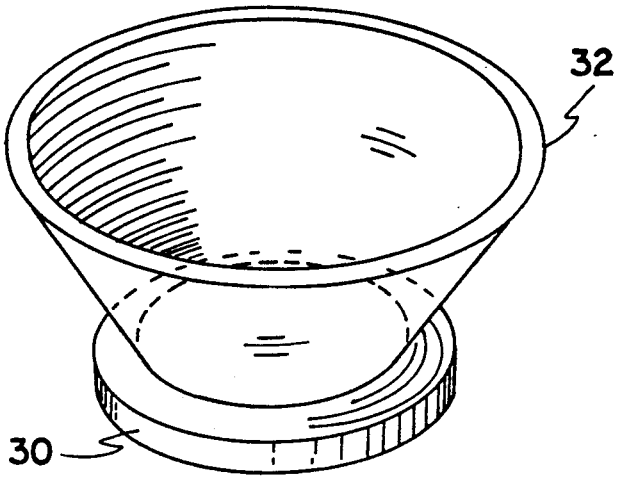

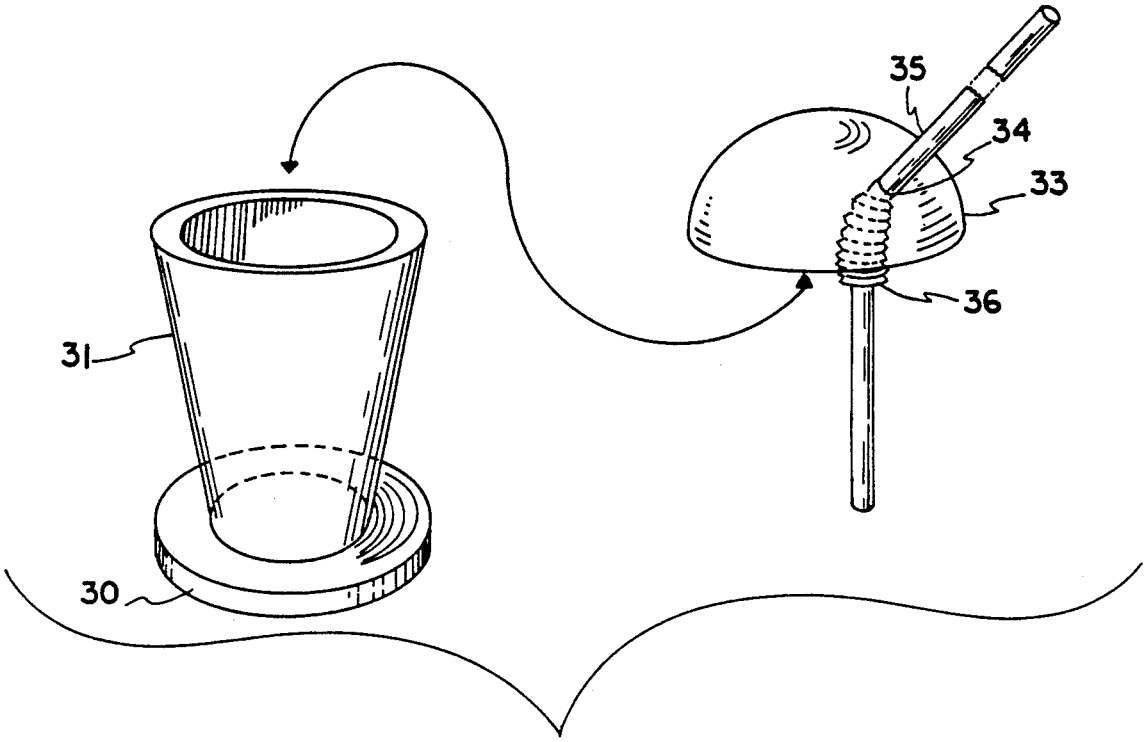
FIG.3B
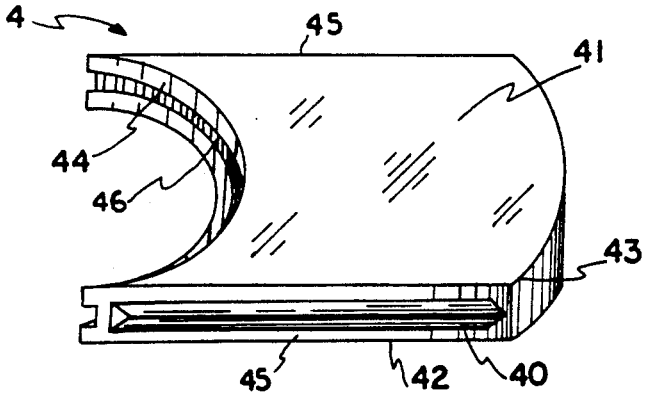
FIG.4
FIG.5
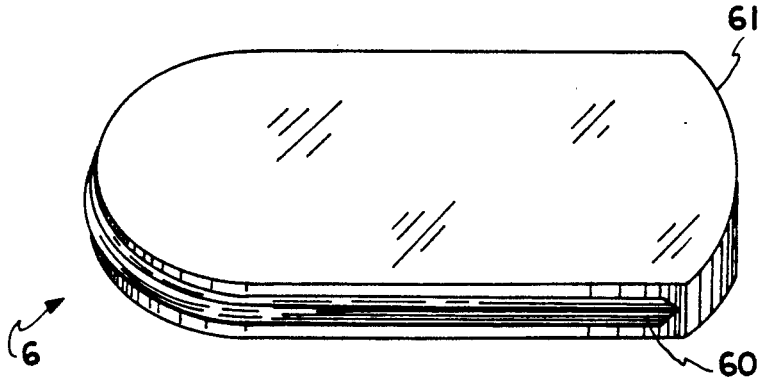

PLATFORM HAVING A NOTCH AND PLUG MEMBER THEREFOR

FIELD OF THE INVENTION

The present invention relates to food serving devices and more specifically to devices with immobilized dishes to minimize spillage.

BACKGROUND OF THE INVENTION

The spilling of both food and beverages by infants and toddlers has long been a problem and concern of those raising the youngsters. Not only is the article of food wasted by the time and effort needed to clean-up after the infant could be spent in more productive pursuits. Additionally, the aggravation and frustration the individual caring for the infant experiences is unnecessary and a stress in life that should be alleviated.

It is conventionally known to provide a void in a surface into which a cup, glass or the like can be inserted to provide support. While this approach provides adequate support during carrying of articles stored therein, since they aren't fixedly attached to the support the cup or glass may have a tendency to cant to one side or another thus spilling its contents.

In the past, various patented inventions have tried to eliminate the spillage problem and resultant aggravation but none has proved to present a viable solution. Pat. No. 1.925,540 issued to Neuschotz discloses a bracket for the support of kitchen glassware and the like. The invention provides for the storage of the articles under the surface of the counter or table in order to improve space utilization. While the invention has the merit of providing a means of storage for the glassware or the like, it would be ill-suited to be used as a method of securing the glassware or the like when consuming food and beverages therefrom.

SUMMARY OF THE INVENTION

By the present invention, an improved apparatus for the fixed attachment of food receptacles to a platform is provided which readily lends itself to ease of use and functionality. The securing of dishes to a high chair tray provides for the prevention of spillage due to the carelessness of children.

Accordingly, one of the objects of the present invention is to provide an improved means of retention of dishes and the like for use by children for the prevention of unwanted spillage.

Additionally, an object of the present invention is to provide a functional solution to the problem of children's spillage which results in wasted food and also time which is necessary to clean up after the child.

A further object of the present invention is to provide a high chair tray which is readily convertible from a platform that provides for the retention of dishes and the like to one which provides a flat surface much like the conventionally known high chair tray.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

FIG. 1 is a top plan view of the platform showing an exploded and in place representation of the food receptacles and retainers;

FIG. 2 is a cross-sectional view taken at II showing the detail of the notch;

FIG. 3A is a perspective view of the dish-like food receptacle;

FIG. 3B is a perspective view of the glass including the cover and straw;

FIG. 4 is a perspective view of the plug to secure the food receptacles;

FIG. 5 is a perspective view of the plug to fill the notches when the dishes are not in use;

Similar reference characters designate corresponding parts throughout the several figures of the drawings.

DESCRIPTION OF THE PREFERRED EMBODIMENT

Figure 6:
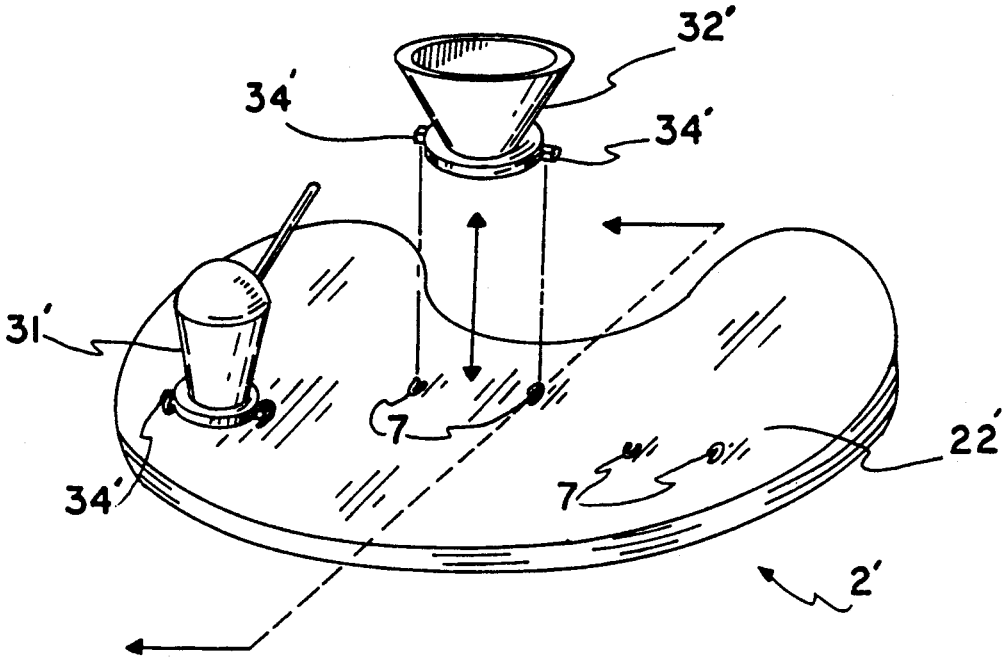
FIG 6 is a perspective view of the platform of the second embodiment including a food receptacle adapted for use with the retention means of the second embodiment.
Figure 7:
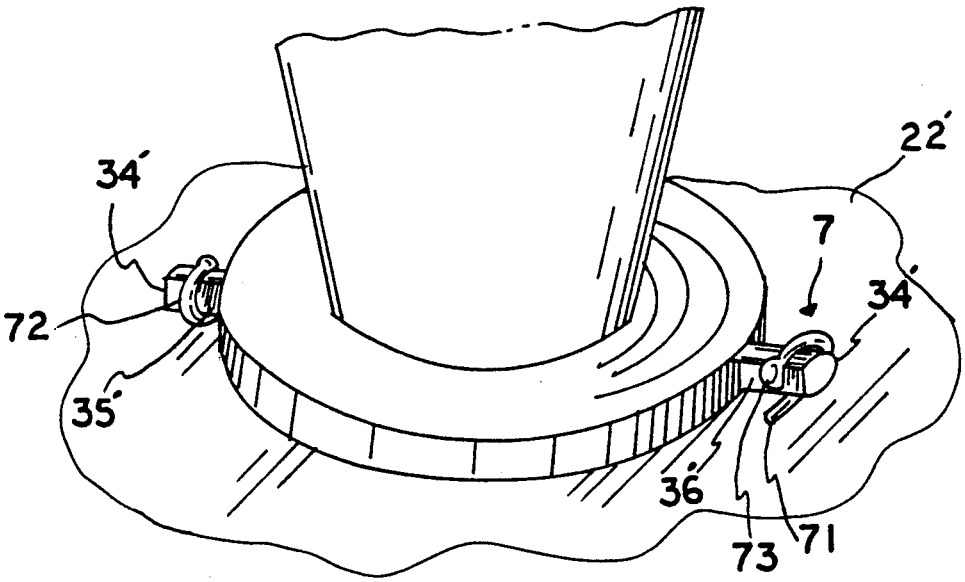
FIG. 7 is a detail of the retention means and food receptacles of the second embodiment.

Referring to FIG. 1, the serving unit generally designated 1 is shown to include a platform 2, a plurality of food servers or receptacles 3 and a plurality of plugs 4 and 6.

The platform 2 is seen to have a periphery similar to a conventionally known high chair tray including a top face 22, a bottom face 20 and an arcuate edge 21 which is generally perpendicular to the top and bottom faces. The platform 2 also includes a plurality of notches 5 about said periphery.

The notches 5 are substantially U-shaped and serve to receive the food receptacles 3 and plugs 4 and 6. The notches 5 include side walls 51 and a semi-circular inner wall **5*a* which lie substantially perpendicular to the top 22 and bottom 20 faces. The notches 5 include a channel 50 along the entire perimeter. The channel is to receive the tracks 40 and 60 located on the plugs 4 and 6, respectively. The channel is an indentation in the wall 51 and provides for mating with both the track 40 of the filler plug member 4 and the track 60 of plug 6. Also, the bases 30 of the food receptacles 3 mate with the channel 50**.

The filler plug 4 is provided with a periphery that mates with the notch 5. The plug includes an upper surface 41, a lower surface 42 and a plurality of walls. These walls include an exterior wall 43, a semi-circular inside wall 44 and side walls 45. The side walls 45 are generally planar and along the centerline thereof, parallel to the surfaces 20, 22, lies the male track 40. The inside wall 44 is provided with a channel 46 mating with the periphery of the food receptacle bases as will be seen hereinafter. The periphery of each track is to mate with the channel 50 of the notch 5. The track 40 is truncated before the edge of the wall. The exterior wall 43 has a periphery which has a radius of curvature that is identical to the radius of curvature of the missing portion of the platform edge 21.

The food receptacles shown in FIGS. 3A and 3B include both a bowl type body 32 and a cup-like body 31 with a cover 33. The bodies include a base 30 which mates within the channel 50 of the notch 5 and channel 46 of the filler plug 4. In addition to the mating of the base 30 to the channel 50, the base arcuate periphery mates with the arcuate slot 45 of the plug 4. This mating facilitates the tight-fit of the insertable bodies and retention of the same. The cover 33 includes an aperture 34 through which the flexible straw 35 is inserted. The straw 35 is provided with flexibility by the accordion style indentations 36.

The plug member 6 is provided for use in the notches 5 when it is desired that the surfaces 20 and 22 and edge 21 be continuous and thus the notch "filled". Included on the plug member 6 is a track 60 to mate with the channel 50 of the notch 5. The use of the plug member 6 provides for the continuity of the platform surfaces and convertibility to a conventionally known high chair tray.

The second embodiment shown in FIG. 6 shows an alternate means of securing the bodies 31' and 32'. The platform 2' includes on its top surface 22' a pair of oppositely facing clips 7. These clips mate with the diametrically opposed tabs 34' to provide retention of the bodies 32' and 31' therebetween.

Each clip 7 is a substantially "C" shaped member which lies substantially perpendicular to the top surface 22'. The clip includes a base 71, a neck 72 and a top lip 73 and is made of a resilient material. The base 71 provides for the attachment point to the top surface 22'. It is essentially flat and flush with the top surface 81. The neck 72 rises from the base 71 and forms the "C" shape. At the end of the neck 72, lies the lip 73. The lip 73 serves to brace and hold the tab 34' through the spring action of the resilient neck. The front edge 35' of the tab 34' slides into the opening provided by the clip 7 and the rear edge 36' makes contact with the lip 73 thus retaining the body.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications, and equivalents which may be resorted to, will be understood to fall within the scope of the invention.

What is claimed is:

1. A serving unit comprising;

a substantially planar platform having top and bottom faces and an outer edge, said platform provided with at least one U-shaped notch vertically extending completely therethrough.

each notch bounded by a semi-circular inner wall joined to a pair of opposed parallel side walls, said side walls terminating with the platform outer edge, the notch side walls each including a longitudinal side wall channel therein spaced from said top and bottom faces, a food server including a food receiving body attached to a base having an arcuate periphery, said arcuate periphery mating within the sidewall channels whereby, said food server is attachable to said platform upon the lateral insertion of said base into a said notch with said arcuate periphery mating within said channels, and a planar plug member having side walls and an inner wall mating with the area as defined by the notch side wall and the notch inner wall, said plug member provided with an outer wall, a track extending outwardly from the plug member side walls and mating with the side wall channels whereby, upon removal of said food server base from a said notch, said plug member is insertable into said notch and retained therein by engagement of the side wall tracks within said channels with said plug member fully filling said notch as the plug member outer wall is juxtaposed said platform outer edge.

2. A serving unit according to claim 1 wherein, the food server base arcuate periphery is circular.

3. A serving unit according to claim 1 including, a removable cover adapted to overlie said food receiving body.

4. A serving unit according to claim 1 including, a plurality of said notches within said platform.

5. A serving unit according to claim 1 wherein, said platform outer edge is arcuate when viewed in plan, and said plug member outer wall includes a curvature providing a smooth continuation of the configuration of the arcuate platform outer edge.

6. A serving unit according to claim 1 wherein, the maximum horizontal dimension of the food server base is less than the distance between a notch inner wall and the termination of its respective notch side walls with said platform outer edge, and a filler plug having side walls provided with outwardly extending tracks mating with the notch side wall channels and an inside wall having a slot mating with a portion of the food server base periphery, whereby following attachment of said food server to said platform, said filler plug is insertable within remaining space defined by a said notch to fully fill said notch.

7. A serving unit according to claim 6 wherein, the filler plug inside wall is semi-circular.

* * * * *